US005720866A

United States Patent [19]

Erokhine et al.

[11] Patent Number: 5,720,866

[45] Date of Patent: Feb. 24, 1998

[54] METHOD FOR FORMING COATINGS BY ELECTROLYTE DISCHARGE AND COATINGS FORMED THEREBY

[75] Inventors: Aleksey Erokhine, Tula, Russian Federation; Andrey Aleksejevich Voevodin, Kettering; Robert David Schmertzler, Centerville, both of Ohio

[73] Assignee: ARA Coating, Inc., Dayton, Ohio

[21] Appl. No.: 663,949

[22] Filed: Jun. 14, 1996

[51] Int. Cl.[6] ..... C25D 21/12; C25D 5/18; C25D 5/00; C25D 11/04

[52] U.S. Cl. ..... 205/83; 205/106; 205/108; 205/109; 205/121; 205/133; 205/137; 205/146; 205/316; 205/319; 205/324

[58] Field of Search ..... 205/82, 83, 84, 205/106, 107, 108, 109, 118, 121, 133, 137, 146, 316, 319, 324

[56] References Cited

U.S. PATENT DOCUMENTS

| | | | |
|---|---|---|---|
| 2,346,658 | 4/1944 | Brennan et al. | 204/58 |
| 2,920,018 | 1/1960 | Miller | 205/324 |
| 2,951,025 | 8/1960 | Mostovych et al. | 205/107 |
| 3,531,385 | 9/1970 | Suzuki | 204/58 |
| 3,812,023 | 5/1974 | Schardein, Jr. et al. | 205/107 |
| 3,862,892 | 1/1975 | Lautenschlager et al. | 204/58 |
| 3,956,080 | 5/1976 | Hradcovsky et al. | 204/56 R |
| 3,983,014 | 9/1976 | Newman et al. | 204/58 |
| 4,659,440 | 4/1987 | Hradcovsky | 204/58 |
| 4,869,789 | 9/1989 | Kurze et al. | 204/56.1 |
| 5,069,763 | 12/1991 | Hradcovsky | 205/326 |
| 5,385,662 | 1/1995 | Kurze et al. | 205/316 |
| 5,427,678 | 6/1995 | Yoshimura et al. | 205/322 |

FOREIGN PATENT DOCUMENTS

| | | |
|---|---|---|
| 7001486 | 8/1971 | Netherlands . |
| 926084 | 5/1982 | U.S.S.R. . |

*Primary Examiner*—Kathyryn L. Gorgos
*Assistant Examiner*—Edna Wong
*Attorney, Agent, or Firm*—Biebel & French

[57] ABSTRACT

A method for forming relatively thick composite coatings on a region of the surface of a metallic member includes exposing the surface region to an electrolyte fluid, either by immersion or by spraying the electrolyte against the surface region. A preferred electrolyte fluid is an aqueous solution including an electrolytic agent, a passivating agent and a modifying agent in the form of a solute or a powder suspended in the solution. A voltage signal is applied to induce a current flow of constant magnitude between the metallic member and the electrolyte fluid so that the metallic member interacts with the passivating agent to form a passive oxide layer on the surface region. The voltage signal increases in magnitude until local voltage reaches a breakthrough level across separate highly localized discharge channels along the surface region of the metallic member. At this breakthrough level, localized plasmas including components of the oxide layer and the modifying agent form near the discharge channel and reacts to form the coating. At some point after the discharges appear, the signal is changed to a series of unipolar anodic pulses interspersed with cathodic pulses which serve to stabilize the growth of the coating.

44 Claims, 2 Drawing Sheets

METHOD FOR FORMING COATINGS BY ELECTROLYTE DISCHARGE AND COATINGS FORMED THEREBY

BACKGROUND OF THE INVENTION

1. Field of the Invention

The present invention pertains to an electrolytic coating process by which a composite coating is formed on a surface region of a metallic (preferably aluminum or aluminum alloy) member. The coating is formed by means of a series of localized high temperature plasma-chemical reactions between a passive oxide layer formed electrolytically on the surface region of the metallic member and a modifying agent dissolved or suspended in an electrolytic fluid.

2. Description of the Related Art

Numerous techniques have been proposed to form protective or decorative coatings on metals such as aluminum and aluminum alloys. One class of techniques relies on electrochemical reactions between the metal and an electrolyte solution to form ceramic oxide coatings along the surface of the metal.

For example, U.S. Pat. No. 3,956,080 to Hradcovsky et al. proposed forming coatings on metallic surfaces by immersing the metal in an electrolyte solution and applying a potential difference with the positive pole being electrically connected to the metal. The electrolyte solution included an alkali metal hydroxide, an alkali metal silicate and an oxyacid "catalyst" added to obtain a harder coating. Hradcovsky et al. also proposed obtaining variations in color and other properties of the coating by adding to the electrolyte solution quantities of other soluble compounds providing anions containing vanadium, arsenic, boron, chromium, titanium, tin, antimony, tungsten, molybdenum or a combination of these in the form of alkali metal salts. The process included gradually increasing the voltage between the metal and a cathode until a spark discharge occurred at the metallic surface. Variations of this technique were proposed in Hradcovsky, U.S. Pat. Nos. 4,659,440 and 5,069,763.

One drawback to the method proposed in Hradcovsky et al. is that the growth of the coating tends to be unstable. As a result, it is difficult to grow thick coatings having desirable physical properties. Therefore, there remains a need in the art for a technique for electrolytically producing composite coatings on metal surfaces in which the growth of the coating is sufficiently stable to produce thick coatings having desirable physical properties.

SUMMARY OF THE INVENTION

These and other objects are met by the method for forming composite coatings on a region of the surface of a metallic member (that is, over the entire surface or a portion of the surface), as disclosed herein.

Briefly, the method includes exposing the surface region of the metallic member to be coated to an electrolyte fluid, either by immersion or by spraying the electrolyte against the surface region of the metallic member. The electrolyte fluid preferably includes a passivating agent and a modifying agent. According to one form of the method, a continuously increasing anodic voltage signal is applied to induce a constant current flow between the metallic member and the electrolyte fluid. According to another form of the method, an asymmetric AC voltage signal (that is, an AC voltage with an anodic DC offset) or asymmetric alternating anodic and cathodic square pulses are used. This current flow causes the metallic member to interact with the passivating agent in the electrolyte fluid to form a passive oxide layer on the surface region. It has been found that the use of a constant current magnitude (that is, the current level in a DC current or the current amplitude in the anodic portion of an alternating or pulsed current) improves the uniformity and quality of the coating.

As the magnitude of the applied voltage signal is increased, the oxide layer heats. At some point, localized areas of the oxide layer melt and form localized plasmas at random locations along the surface region of the metallic member. At this "breakthrough voltage level," the impedance across the surface of the metallic member decreases rapidly, and observable spark discharges arc between the metallic member and the surrounding electrolyte fluid. The localized plasmas include both metal oxide from the surface of the metallic member and modifying agent from the electrolyte fluid, which react to coat the surface immediately below the localized plasma.

The heat generated as these localized plasmas are formed induce the formation of plasmas immediately adjacent the positions of the initial spark discharges. In this manner, the spark discharges spread out in circles away from the positions of the initial discharges. The spreading of the discharges leads to the growth or spread of the coating outwardly along the surface region of the metallic member from the positions of the initial discharges.

While the heat generated by the plasmas contributes to the spread of the coating over the surface, it also tends to counteract that spread by changing the dielectric characteristics of the surface proximate the discharges. In particular, the heating of the metal surface raises the local dielectric constant, which increases the power required to maintain a constant current flow across the surface. In addition, the anodic current serves to convert the insoluble metal oxide layer to water-soluble compounds such as hydroxides. The dissolution of such compounds into the electrolyte fluid depletes the oxide layer and slows the spread of the coating over the surface region. In this manner, the heating of the surface region eventually slows the spread of the coating. Since the coating continues to grow into and out of the surface, these phenomena may lead to differences in coating thickness along the surface region.

It has been discovered that these phenomena manifest themselves in an instability or oscillation in the voltage demanded to maintain a constant current magnitude across the surface of the metallic member. At least in the case of an increasing DC voltage, this instability or oscillation can be detected automatically by determining when the voltage changes by more than a set amount within a fixed period of time. Alternatively, the rate at which the spark discharges spread along the surface region can be observed visually.

When this instability or oscillation sets in, the signal is switched to a series of square anodic pulses (that is, pulses switching between ground and an anodic voltage magnitude). Cathodic pulses having current magnitudes equal to, or less than, the current magnitude of the anodic pulses are interspersed with the anodic pulses as a means to interrupt the spark discharges, permit the surface to cool and induce the re-conversion of soluble compounds into metal oxide. The switch from DC or asymmetric alternating voltage to anodic pulses thus serves to stabilize the spread of the plasma reactions and promotes uniformity of the coating.

Preferably, the metallic member is composed of aluminum or an aluminum alloy. This includes members made from rolled or cast aluminum or aluminum alloy as well as sintered composite aluminum-based materials.

Alternatively, the coating may be formed on a member having a layer of aluminum deposited on its surface, as by plating or other means known to those of ordinary skill in the art.

The first step in the process is to prepare the electrolyte fluid. The preferred electrolyte fluid is an aqueous solution containing 0.01 to 90 wt % of an electrolytic agent, 0.01 to 60 wt % of a passivating agent capable of interacting with the metallic member to form the passive oxide layer, and 0.001 to 30 wt % of a modifying agent capable of reacting with the passive oxide layer to form the composite coating. (The total of all solutes is 100 wt %.) Preferred electrolytic agents include strong acids, strong alkalis and salts such as $H_2SO_4$, KOH, NaOH, NaF, $Na_2SO_4$, $H_3PO_4$ and $Na_3PO_4$. Preferred passivating agents include silicate, polyphosphate, chromate, molybdenate, vanadate, tungstenate and aluminate salts such as $Na_2SiO_3$, $K_2SiO_3$, $Na_6P_6O_{18}$, $K_6P_6O_{18}$, $Na_2Cr_2O_7$, $K_2Cr_2O_7$, $Na_2Mo_2O_7$, $K_2Mo_2O_7$, $Na_2V_2O_7$, $K_2V_2O_7$, $Na_2WO_4$, $K_2WO_4$, $NaAlO_2$ and $KAlO_2$.

The modifying agent is either dissolved in the electrolyte fluid or suspended in an insoluble powder form. Preferred modifying agents include metals and Group IVb elements such as carbon and silicon, either unalloyed, or in oxide, carbide, boride or nitride form. In an especially preferred embodiment, the modifying agent is a powder lubricant such as graphite, $MoS_2$, $WS_2$, PbO and $NbSe_2$ having a hexagonal close-packed crystalline structure and weak bonding between slip planes in the lattice. The choice of the modifying agent, and to some extent of the electrolytic and passivating agents, is dependent on the desired characteristics of the finished coating.

In some applications, 0.01 to 10 wt % of a stabilizing agent is added to balance the pH of the electrolyte fluid and to permit the electrolyte fluid to be stored. Preferred stabilizing agents include acids, alkalis and salts.

The next step is to prepare the metallic member. This preparation includes cleaning the surface of the part to remove any grease or oil which might interfere with the formation of the coating or contaminate the finished coating. If it is desired to coat only a portion of the surface of a small member, other surface regions are masked in a manner known to those of ordinary skill in the art.

The cleansed metallic member is then exposed to the electrolyte fluid, either by immersing all or a portion of the metallic member in an electrolyte bath or, in the case of larger members, by spraying the electrolyte fluid onto the surface region to be coated. Clamping means, preferably movable, are provided to hold the metallic member in contact with the electrolyte fluid. In the former case, it is preferred that means be provided to circulate, cool and regenerate the electrolyte fluid so that the fluid temperature and the concentrations of the dissolved or suspended agents in the electrolyte fluid near the surface region continue to be relative stable.

A voltage signal is applied between the metallic member and the electrolyte fluid, which induces the metallic member to interact with the passivating agent in the electrolyte fluid to form a passive oxide coating on the metallic member. That is, the metallic member is connected as an anode in a circuit in which current flows through the electrolytic fluid between the metallic member and either the electrolyte bath structure or independent electrode structure. Preferably, during the formation of the passive oxide layer, the applied voltage signal is a continuously increasing DC voltage which induces a constant current flow between the metallic member and the electrolyte fluid. In this regime, the current density is set on the order of 10 $A/cm^2$ and maintained constant at that level in order to provide a uniform passive layer. As the passive layer grows, the electrical resistance across the surface region of the metallic member increases, thereby requiring that the applied voltage be increased continuously to maintain a constant current. The magnitude of the voltage signal is increased beyond the breakthrough level at which spark discharges are observed, which occurs at approximately 150–300 V for aluminum and aluminum alloy members.

In the alternative, the current is maintained at a constant magnitude of not less than approximately 0.5 $A/cm^2$ and an asymmetric alternating voltage of continuously increasing magnitude having a frequency between approximately 1–300 Hz is applied between the metallic member and the electrolyte fluid. This alternating voltage signal is applied in the form of either an AC voltage with a DC offset or a train of alternating square anodic and cathodic pulses such that the cathodic pulses have a smaller magnitude than the anodic pulses. The cathodic portion of the alternating voltage serves to prevent the growing passive oxide layer from converting to soluble compounds such as aluminum hydroxide and dissolving, thereby promoting the uniformity of that layer. The ratio of the current magnitude of the cathodic portion of the signal to that of the anodic portion is set between approximately 0.5:1 to 2:1, and the ratio is maintained constant until an instability or oscillation in the voltage demand is observed.

This voltage is monitored until an instability or oscillation is observed, at which point the voltage regime is changed to stabilize the spread of the coating over the surface. According to one form of the invention, this instability or oscillation is detected when the the voltage magnitude changes by more than a fixed percentage in a preselected period of time. Once this instability or oscillation is detected, unipolar anodic pulses are substituted for the DC or asymmetric alternating signals that were used to grow the passive oxide layer. The current level induced by the anodic pulses remains constant.

These unipolar anodic pulses are interspersed with cathodic pulses which temporarily interrupt the formation of localized discharge arcs to permit the portions of the surface region proximate the discharges to cool, as well as to induce the conversion of soluble compounds such as aluminum hydroxide back into oxide. The magnitudes of the cathodic pulses are maintained in proportion to the magnitudes of the anodic pulses. The frequency of the cathodic pulses and the ratio of the magnitude of the anodic pulses to the magnitude of the cathodic pulses depends on the nature of the metallic member, the modifying agent and the coating unit in which the coating takes place. As the magnitude of the anodic pulses increases, the frequency of the cathodic pulses preferably decreases.

Another technique for promoting the uniformity of the composite coating is to sequentially coat different portions of the metallic member. By reducing the surface region coated in any one operation, greater control is achieved over coating properties. Where the metallic member is partially or completely immersed in the electrolyte fluid, different surface regions can be sequentially coated by using an asymmetric alternating voltage signal rather than DC voltage to form the oxide layer and by moving the metallic member relative to the bath structure or independent electrode across which the voltage is applied. (In the case of an independent electrode, the relative movement can be achieved by moving the electrode rather than the metallic part itself.) Where the metallic member is exposed to a spray of the electrolyte fluid, the metallic member is moved relative to the spray to expose different surface regions of the member.

The method of the present invention produces thicker coatings of greater uniformity than were produced by prior art methods. Apart from thickness and uniformity, the method produces coatings having desirable physical characteristics such as high hardness and elastic modulus, excellent adhesion, low friction, high dielectric constant and high ohmic resistance. The coatings are also characterized by good corrosion protection properties.

Therefore, it is one object of the invention to electrolytically produce composite coatings on surface regions of metallic members such as aluminum or aluminum alloy members. The invention will be further described in conjunction with the appended drawings and following detailed description.

DETAILED DESCRIPTION OF THE PREFERRED EMBODIMENT

The method of the present invention begins by exposing the surface region of the metallic member to be coated to an electrolyte fluid, preferably an aqueous solution containing approximately 0.01 to 90 wt % electrolytic agent, 0.01 to 60 wt % passivating agent, and 0.001 to 30 wt % modifying agent. In the first stage a continuously increasing anodic signal or an asymmetric bipolar signal of increasing voltage magnitude having a frequency between approximately 1–300 Hz is applied to induce a constant magnitude of current flow between the metallic member. This current flow causes the metallic member to interact with the passivating agent in the electrolyte fluid to form a passive oxide layer on the surface region. The magnitude of the voltage signal is increased until local voltages across the surface region of the metallic member reach a breakthrough level, at which point spark discharges appear on the surface region indicating that the composite coating has begun to form. As the coating grows on the surface region of the metallic member, the applied voltage regime is changed to one of unipolar anodic pulses of increasing magnitude interspersed with cathodic pulses to stabilize the growth of the coating.

Figure 1:
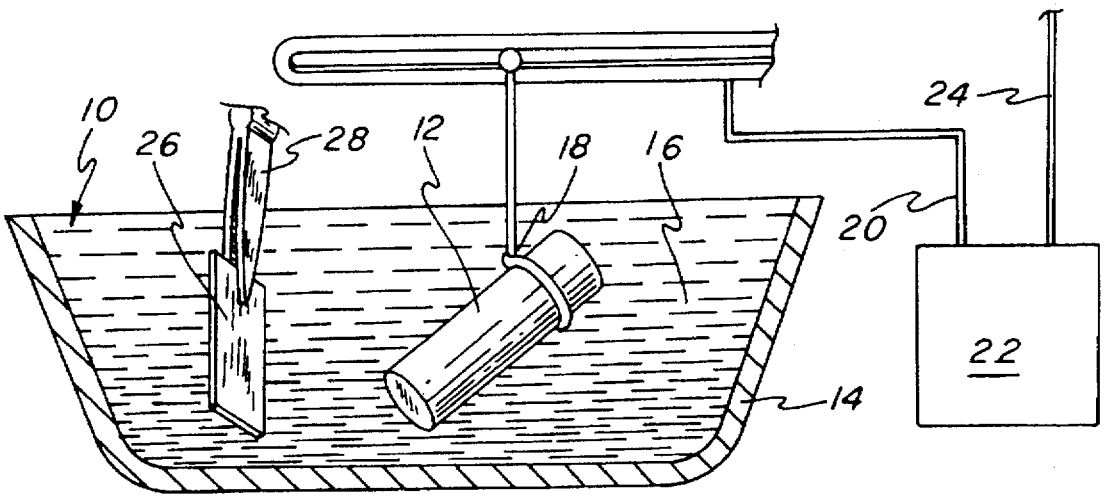
FIG. 1 is a schematic diagram showing an electrolyte bath apparatus for use in electrolytically coating metallic members.

FIG. 1 shows a portion of an electrolyzer or coating unit 10 for use in coating a metallic member 12. The coating apparatus 10 includes a bath structure or bath 14 which holds an electrolyte fluid 16. The metallic member 12 is partially or completely immersed in the electrolyte fluid 16 and is supported by conventional means as at 18. In addition, the metallic member 12 is electrically coupled by conventional means to a first output 20 of an electric power supply 22.

The preferred coating unit 10 also includes means (not shown) for circulating, regenerating and cooling the electrolyte fluid 16 to maintain a controlled fluid temperature and solute composition near the metallic member 12. Conventional circulating means include devices which force compressed air through the electrolyte 16 to mix it; magnetically driven mechanical mixers and electrically driven mixers. Conventional regenerating means include ion exchange units and refreshing units equipped with composition controllers. Conventional cooling means include water jackets, heat sinks and other heat exchange systems. In an especially preferred form, the electrolyte fluid 16 is maintained at a temperature in the range of between −4° C. to 80° C. during the coating process.

The preferred electrical power supply 22 is a controlled voltage and current supply capable of generating direct current, unipolar pulsed current (1–300 Hz) and asymmetric alternating current signals (1–300 Hz). The supply 22 should be capable of inducing constant current magnitudes between the metallic member 12 and the electrolyte fluid 16 in the range up to approximately 10 A/cm$^2$. It should also be capable of generating signals having voltage magnitudes in the range from 0 V up to 1000 V, and of generating asymmetric anodic and cathodic pulses such that the ratio of the magnitude of the anodic pulses to the magnitude of the cathodic pulses ranges from 0.5:1 to 2:1.

In an especially preferred form, the bath structure 14 is composed of an electrically conductive material such as stainless steel or graphite, and is coupled to a second outlet 24 of the electrical power supply 22 to establish the applied voltage between the metallic member 12 and the electrolyte fluid 16. Alternatively, if the bath structure 14 is composed of a non-conductive material, an electrode 26 composed of an electrically conductive material such as stainless steel, graphite, lead, silver, gold or platinum is coupled to the second outlet 24 and supported by conventional means as at 28 in contact with the electrolyte fluid 16 proximate the metallic member 12. Additional electrodes (not shown) are used to coat metallic members with complicated shapes. The ratio of the area of the interior of the bath structure 14 or of the electrode 26 to the area of the surface region (not shown) of the metallic member 12 to be coated should be at least 3:1.

The preferred electrolyte fluid 16 is an aqueous solution containing 0.01 to 90 wt % electrolytic agent, 0.01 to 60 wt % passivating agent, 0.001 to 30 wt % modifying agent and, in some applications, 0.01 to 10 wt % stabilizing agent, the total adding up to 100 wt %. The modifying agent is either dissolved in the electrolyte fluid or suspended in the fluid in powder form. One especially preferred electrolyte fluid composition, which has been found to produce relatively hard composite coatings, includes 0.01 to 1 wt % KOH and 0.01 to 1 wt % $Na_2SiO_3$, in addition to a modifying agent. Another especially preferred electrolyte fluid composition, which has been found to produce more porous coatings, includes 0.01 to 1 wt % KOH and 10 to 15 wt % $Na_2SiO_3$, in addition to a modifying agent. It has been found that the former composition induces growth of the composite coating inwardly from the surface of the metallic member 12, while the latter composition induces growth of the composition outwardly from the surface.

Figure 2:
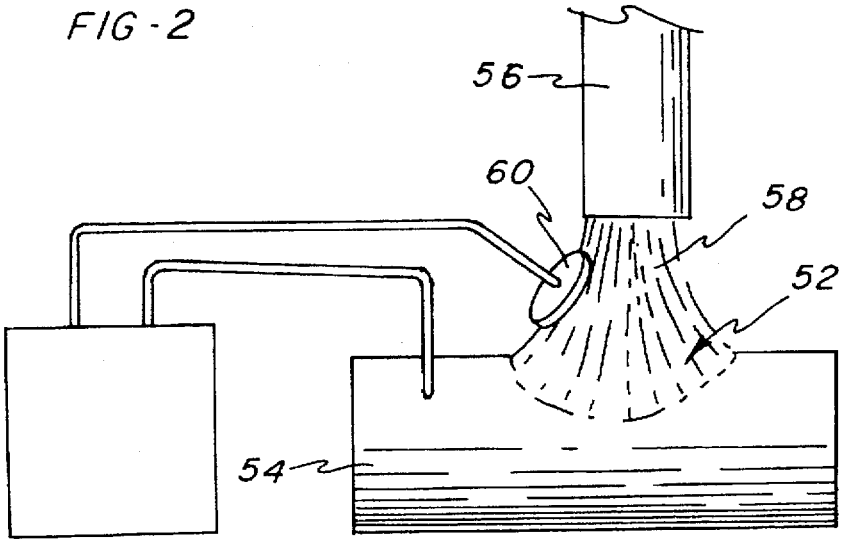
FIG. 2 is a schematic diagram showing an electrolyte spray apparatus for use in coating large metallic members.

FIG. 2 shows an alternative coating unit 50 for coating a surface region 52 of a large metallic member 54. The coating unit 50 includes a nozzle 56 for directing a spray of electrolyte fluid 58 against a surface region 52 and an electrode 60 placed in contact with the spray of electrolyte fluid 58. It is critical in that constant flow rate be maintained in the spray of electrolyte fluid 58 so that the current flow between the metallic member 54 and the electrode 60 does not fluctuate. If it is desired to coat the entire surface of the metallic member 54, different surface regions 52 are coated sequentially by moving the metallic member 54 relative to the nozzle 56.

The invention will be further explained in conjunction with the following example which is included as being illustrative of the invention and should not be construed to limit the scope of the invention.

EXAMPLE

A hard antifriction coating 180–220 μm thick was deposited on an aluminum alloy part containing 89.5 wt % aluminum, 9 wt % silicon and 1.5 wt % magnesium. The part was first cleaned to remove oil and grease. The cleansed part was then coupled to a power supply and immersed in an aqueous solution comprising 2 to 5 g/l KOH, 2 to 40 g/l $Na_2SiO_3$, and 5 to 20 g/l of a modifying agent. The modifying agent consisted of a 0.5–2.0 mm fraction of a powdered mixture of $MoS_2$ and graphite, combined in a mass ratio of 1:2 to 2:1.

The part was then coupled to one terminal of an electrical power source with automatic voltage and current control. Initially, a DC electric signal having a constant current of approximately 15–20 A/dm$^2$ was applied between the part and the aqueous solution. The voltage was increased linearly to approximately 240–300 V, maintaining a constant current, at which point discharge arcs were observed on the surface of the part. The voltage was now raised more slowly to approximately 450–500 V, still maintaining a constant voltage.

At approximately 450–500 V, the voltage magnitude required to maintain a constant current increased by more than 25% within a single sampling period, indicating an instability or oscillation in the voltage demand. At this point, the DC signal was replaced by a train of anodic pulses interspersed with cathodic pulses. The magnitude of the voltage of the anodic pulses was set initially at approximately 400–450 V, and increased with time to maintain a constant current magnitude. The magnitude of the current of the cathodic pulses was set to be between 90%–100% of the magnitude of the anodic current.

When the voltage magnitude of the anodic pulses again approached 500 V, the voltage magnitude of the cathodic pulses was reduced such that the current magnitude of the cathodic pulses fell to approximately 50%–60% of the current magnitude of the anodic pulses. Simultaneously, the frequency of the cathodic pulses was reduced. This voltage regime was continued until the end of the coating process, after which the coated part was removed from the aqueous solution and washed.

Figure 3:
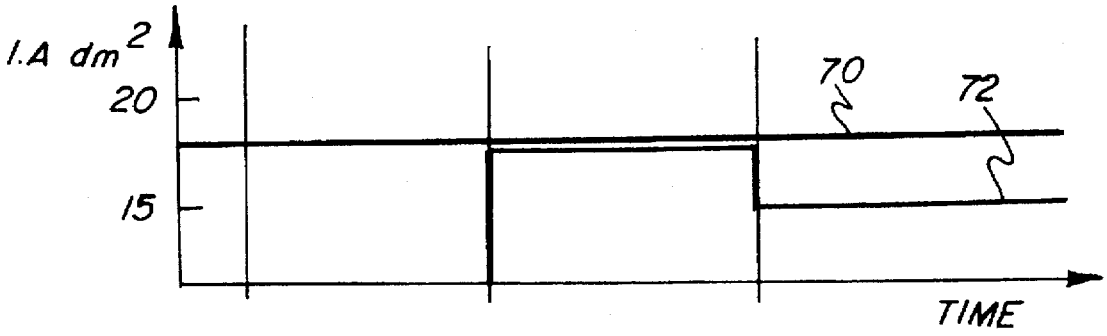
FIG. 3 is a timing diagram showing current flow between the metallic member and the electrolyte fluid in an example illustrating the method.
Figure 4:
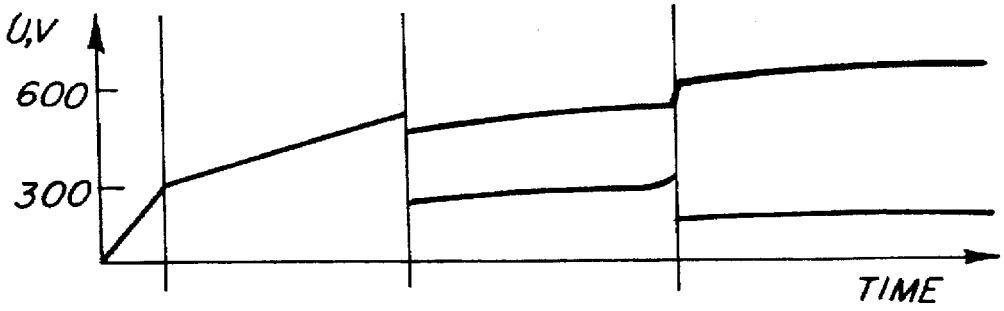
FIG. 4 is a timing diagram showing applied voltage between the metallic member and the electrolyte fluid in the example also illustrated in FIG. 3.
Figure 5:
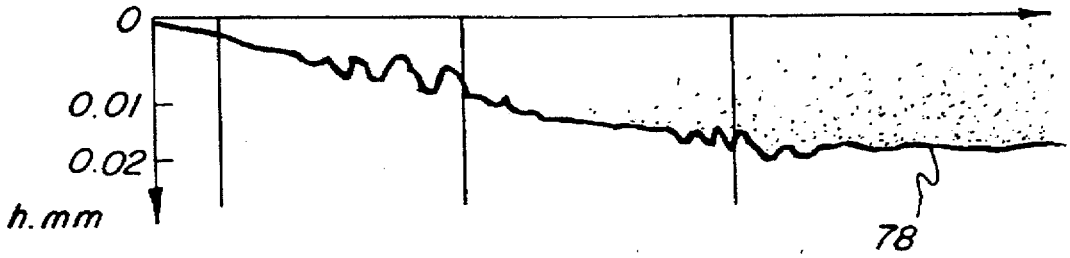
FIG. 5 is a diagram showing coating growth as a function of time in the example also illustrated in FIGS. 3 and 4.

FIGS. 3 and 4 are timing diagrams showing the current and voltage magnitudes applied in the example. FIG. 5 is a timing diagram showing the thickness of the coating as a function of time. As shown in FIG. 3, the magnitude of the current induced by the anodic pulses, shown by line 70, remained constant throughout the coating process. The current induced by the cathodic pulses is shown by reference numeral 72 in FIG. 3.

During a first phase of the process, shown by reference numeral 74 in FIG. 4, an anodic DC voltage was slowly raised in an approximately linear fashion from 0 V to approximately 240–300 V to maintain a constant current despite increased resistance across the surface of the part due to passive oxide layer growth. As shown at 76 in FIG. 5, the passive oxide layer grew steadily on the surface of the part during this first phase.

At approximately 240–300 V, spark discharges began to appear on the surface of the part and the antifriction coating began to form. At this point, a second phase of the process began. As shown at 78 in FIG. 4, a linearly increasing anodic DC voltage was applied between the part and the aqueous solution. At first, the coating thickness continued to increase linearly with time, as shown at 80 in FIG. 5. As the voltage approached approximately 400–500 V, however, the voltage demand began to oscillate, as at 82. This oscillation 82 in the voltage demand, which was detected as a change of more than 25% in the voltage magnitude within a sampling period, corresponded to an instability in the coating thickness, as at 84, presumably due to local heating of the part surface.

During a third phase of the process which began subsequent to the detection of the instability 82, the anodic DC voltage was replaced by a train of anodic square pulses interspersed with cathodic square pulses in order to stabilize the growth of the coating. As shown at 86 in FIG. 4, the voltage magnitude of the anodic pulses initially dropped to approximately 400 V, but rose with time to approximately the magnitude at which the instability 82 set in during the second phase. At all times, a constant current magnitude was maintained. The voltage magnitude of the cathodic pulses, shown at 88 in FIG. 4, was raised proportionately to remain approximately half the voltage magnitude 86 of the anodic pulses. This change in the voltage regime briefly stabilized the coating growth, as shown at 90 in FIG. 5, though the growth eventually became unstable again, as shown at 92.

Near the end of the third phase, the magnitude of the cathodic pulses required to maintain a constant induced current increased non-linearly, as at 94. While not wishing to be bound by any theory of operation, it is believed that, as the radii of the discharge arcs approached the particle size of the modifying agent, particles of the modifying agent were being drawn into the regions of the discharge arcs by electrostatic forces. This process, in turn, altered the coating dielectric characteristics, leading to the observed increase in required cathodic voltage magnitude. This increasing cathodic voltage magnitude, in turn, threatened to decompose the modifying agent so that the lubricating characteristics of the modifying agent would be lost.

During a fourth phase of the process, the magnitude and frequency of the cathodic pulses, as shown at 96, was reduced still further in order to inhibit the decomposition of the modifying agent. At the same time, the magnitude of the anodic pulses, shown at 98, was increased rapidly to approximately 600 V. The anodic voltage 98 was again raised slowly to maintain a constant current magnitude, while the cathodic voltage 96 was raised proportionately. As shown at 100 in FIG. 5, this change in the voltage regime stabilized the growth of the coating layer through the end of the coating process.

As shown by the previous description and example, it is an object of the invention to provide a method by which a relatively thick, uniform composite coating having desirable physical characteristics may be formed on a region of the surface of a metallic member, such as a member formed from aluminum or aluminum alloy.

Various changes or modifications in the invention described may occur to those skilled in the art without departing from the true spirit or scope of the invention. The above description of preferred embodiments of the invention is intended to be illustrative and not limiting, and it is not intended that the invention be restricted thereto but that it be limited only by the true spirit and scope of the appended claims.

What is claimed is:

1. A method for producing a coating on a metallic member comprising the steps of:

(a) exposing a surface region of the metallic member to an electrolyte fluid including a passivating agent and a modifying agent;

(b) inducing an electrical anodic signal between the metallic member and the electrolyte fluid;

(c) increasing a voltage magnitude of the electrical anodic signal at a constant current magnitude to induce the formation of an oxide layer on the surface region of the metallic member and to induce the reaction of the oxide layer with the modifying agent;

(d) monitoring the voltage magnitude of the electrical anodic signal; and (e) inducing at least one cathodic square pulse between the metallic member and the electrolyte fluid when a change in the voltage magnitude greater than a threshold voltage value is determined in the monitoring step (d).

2. The method as recited in claim 1 wherein the metallic member comprises a material selected from the group consisting of aluminum and aluminum alloy.

3. The method as recited in claim 1 wherein the modifying agent is suspended in the electrolyte fluid in powder form.

4. The method as recited in claim 1 wherein the modifying agent includes a component selected from the group consisting of metal, metal oxide, metal carbide, metal boride, metal nitride, and mixtures thereof.

5. The method as recited in claim 1 wherein the modifying agent includes a component selected from the group consisting of Group IVb elements and their compounds.

6. The method as recited in claim 1 wherein the modifying agent is a powder lubricant having a hexagonal close-packed structure defining slip planes.

7. The method as recited in claim 6 wherein the powder lubricant is selected from the group consisting of graphite, $MoS_2$, $WS_2$, PbO and $NbSe_2$.

8. The method as recited in claim 1 wherein the electrolyte fluid includes 0.01 to 60 wt % of the passivating agent and 0.001 to 30 wt % of the modifying agent.

9. The method as recited in claim 1 wherein the electrolyte fluid is an aqueous solution including 0.01 to 90 wt % electrolyte, 0.01 to 60 wt % of the passivating agent, and 0.001 to 30 wt % of the modifying agent.

10. The method as recited in claim 1 wherein the electrolyte fluid is an aqueous solution including 0.01 to 90 wt % electrolyte, 0.01% to 60 wt % of the passivating agent, 0.001 to 30 wt % of the modifying agent and 0.01 to 10 wt % of a stabilizing component.

11. The method as recited in claim 1 wherein step (a) includes immersing the metallic member in the electrolyte fluid.

12. The method as recited in claim 1 wherein step (a) includes spraying the electrolyte fluid onto the surface region.

13. The method as recited in claim 1 wherein the electrical signal is selected from the group consisting of a DC signal, an AC signal with an anodic DC offset and a signal including alternating anodic and cathodic pulses such that a current magnitude of the cathodic pulses is less than a current magnitude of the anodic pulses.

14. The method as recited in claim 1 wherein the threshold value is a preset value.

15. The method as recited in claim 1 wherein the inducing step (b) includes inducing the electrical anodic signal between the metallic member and an electrode placed in electrical communication with the electrolyte fluid, and wherein the method includes the additional step of moving the metallic member relative to the electrode.

16. The method as recited in claim 1 wherein the modifying agent is a powder of pure metal.

17. The method as recited in claim 1 wherein the voltage value is a preset fraction of a measured value of the voltage magnitude.

18. The method as recited in claim 1 wherein step (e) includes the steps of inducing a second electrical signal comprising sequences of anodic square pulses with interspersed cathodic square pulses without delays between the metallic member and the electrolyte fluid and increasing a second voltage magnitude of the second electrical signal at a constant current magnitude.

19. The method as recited in claim 18 including the additional step of decreasing a frequency of the interspersed cathodic square pulses as the second voltage magnitude is increased.

20. The method as recited in claim 1 repeated on a plurality of surface regions of the metallic member.

21. A method for producing a coating on a metallic member composed at least in part of a material selected from the group consisting of aluminum and aluminum alloys, comprising the steps of:

(a) exposing a surface region of the metallic member to an aqueous electrolyte solution including 0.01 to 90 wt % electrolyte, 0.01 to 60 wt % passivating agent, and 0.001 to 30 wt % modifying agent, at least a portion of the modifying agent being in the form of an undissolved powder;

(b) inducing an electrical anodic signal between the surface region of the metallic member and the electrolyte solution, the electrical anodic signal being selected from the group consisting of a DC voltage and an AC voltage with an anodic DC offset;

(c) increasing a voltage magnitude of the electrical anodic signal at a constant current magnitude to induce the formation of an oxide layer on the surface region of the metallic member and to induce the reaction of the oxide layer with the modifying agent;

(d) monitoring the voltage magnitude of the electrical anodic signal; and (e) inducing at least one cathodic square pulse between the metallic member and the electrolyte solution when a change in the voltage magnitude greater than a first threshold voltage value is determined in the monitoring step (d).

22. The method as recited in claim 21 wherein the modifying agent includes a component selected from the group consisting of metal, metal oxide, metal carbide, metal boride, metal nitride, and mixtures thereof.

23. The method as recited in claim 21 wherein the modifying agent includes a component selected from the group consisting of Group IVb elements and their compounds.

24. The method as recited in claim 21 wherein the modifying agent is a powder lubricant having a hexagonal close-packed structure defining slip planes.

25. The method as recited in claim 24 wherein the powder lubricant is selected from the group consisting of graphite, $MoS_2$, $WS_2$, PbO and $NbSe_2$.

26. The method as recited in claim 21 wherein the electrolyte solution further includes 0.01 to 10 wt % of a stabilizing component and has a substantially neutral pH.

27. The method as recited in claim 21 wherein the first threshold voltage value is a preset value.

28. The method as recited in claim 21 wherein the modifying agent is a powder of pure metal.

29. The method as recited in claim 21 wherein the first threshold voltage value is a preset fraction of a measured value of the voltage magnitude.

30. The method as recited in claim 21 wherein step (e) includes the steps of:

(e)(i) inducing a second electrical signal comprising sequences of anodic square pulses with interspersed cathodic square pulses without delays between the metallic member and the electrolyte solution; and (e)(ii) increasing a second voltage magnitude of the second electrical signal at a constant current magnitude.

31. The method as recited in claim 30 including the additional step of decreasing a frequency of the interspersed cathodic square pulses as the second voltage magnitude is increased.

32. The method as recited in claim 30 including the additional steps of:

(f) monitoring the second voltage magnitude; and (g) changing a frequency of the interspersed cathodic square pulses when a change in the second voltage magnitude greater than a second threshold voltage value is determined in the monitoring step (f).

33. The method as recited in claim 30 including the additional steps of:

(f) monitoring the second voltage magnitude; and (g) changing a proportion between a magnitude of the sequence of anodic square pulses and magnitudes of the interspersed cathodic square pulses when a change in the second voltage magnitude greater than a second threshold voltage value is determined in the monitoring step (f).

34. The method as recited in claim 21 repeated on a plurality of surface regions of the metallic member.

35. A method for producing a coating on a metallic member composed at least in part of a material selected from the group consisting of aluminum and aluminum alloys, comprising the steps of:

(a) exposing a surface region of the metallic member to an aqueous electrolyte solution including 0.01 to 90 wt % electrolyte, 0.01 to 60 wt % passivating agent, and 0.001 to 30 wt % modifying agent, at least a portion of the modifying agent being in the form of an undissolved powder;

(b) inducing a first electrical signal between the metallic member and the electrolyte solution, the first electrical signal comprising a sequence of alternating anodic and cathodic square pulses without delays such that a current magnitude of the alternating cathodic square pulses is less than a current magnitude of the alternating anodic square pulses;

(c) increasing a first voltage magnitude of the first electrical signal at a constant current magnitude to induce the formation of an oxide layer on the surface region of the metallic member and to induce the reaction of the oxide layer with the modifying agent;

(d) monitoring the first voltage magnitude;

(e) inducing a second electrical signal comprising sequences of anodic square pulses with interspersed cathodic square pulses without delays between the metallic member and the electrolyte solution when a change in the first voltage magnitude greater than a first threshold voltage value is determined in the monitoring step (d); and (f) increasing a second voltage magnitude of the second electrical signal at a constant current magnitude.

36. The method as recited in claim 35 wherein the first threshold voltage value is a preset value.

37. The method as recited in claim 35 including the additional steps of:

(g) monitoring the second voltage magnitude; and (h) changing a frequency of the interspersed anodic and cathodic pulses when a change in the second voltage magnitude greater than a second threshold voltage value is determined in the monitoring step (g).

38. The method as recited in claim 35 wherein the modifying agent is a powder of pure metal.

39. The method as recited in claim 35 wherein the first threshold voltage value is a preset fraction of a measured value of the voltage magnitude.

40. The method as recited in claim 35 including the additional step of decreasing a frequency of the interspersed cathodic square pulses as the second voltage magnitude is increased.

41. The method as recited in claim 35 including the additional steps of:

(f) monitoring the second voltage magnitude; and (g) changing a proportion between a magnitude of the sequence of anodic square pulses and magnitudes of the interspersed cathodic square pulses when a change in the second voltage magnitude greater than a second threshold voltage value is determined in the monitoring step (f).

42. The method as recited in claim 35 repeated on a plurality of surface regions of the metallic member.

43. A method for producing a lubricating coating on a metallic member composed at least in part of a material selected from the group consisting of aluminum and aluminum alloys, comprising the steps of:

(a) exposing a surface region of the metallic member to an electrolyte bath including 2 to 5 g/l KOH, 2 to 40 g/l $Na_2SiO_3$, and 5 to 20 g/l of a modifying agent including powdered $MoS_2$ and powdered graphite combined in a 1:2 to 2:1 ratio by weight;

(b) inducing a first electrical signal between the metallic member and the electrolyte bath;

(c) increasing a first voltage magnitude of the first electrical signal at a constant current magnitude to induce the formation of an oxide layer on the surface region of the metallic member and to induce the reaction of the oxide layer with the modifying agent to form the lubricating coating on at least a portion of the surface region;

(d) monitoring the first voltage magnitude of the first electrical signal;

(e) inducing a second electrical signal comprising sequences of anodic square pulses with interspersed cathodic square pulses without delays between the metallic member and the electrolyte bath when a change in the first voltage magnitude greater than a first threshold voltage value is determined in the monitoring step (d); and (e) increasing a second voltage magnitude of the second electrical signal at a constant current magnitude.

44. A method for producing a coating on a metallic member comprising the steps of:

(a) exposing a surface region of the metallic member to an electrolyte fluid including a passivating agent and a modifying agent;

(b) inducing an electrical signal comprising a sequence of alternating anodic and cathodic square pulses without delays between the metallic member and the electrolyte fluid;

(c) increasing an anodic voltage magnitude of the anodic square pulses to maintain a constant anodic current magnitude; and (d) increasing a cathodic voltage magnitude of the cathodic square pulses to maintain a constant ratio between the cathodic voltage magnitude to the anodic voltage magnitude of 0.2 to 0.5.

* * * * *